United States Patent [19]

Stoffel et al.

[11] 4,221,228

[45] Sep. 9, 1980

[54] PIECE PART WASHER

[75] Inventors: Robert P. Stoffel, Roselle; Bruno J. Ezerski, LaGrange, both of Ill.

[73] Assignee: Advanced Curing Systems, Inc., Chicago, Ill.

[21] Appl. No.: 942,617

[22] Filed: Sep. 15, 1978

[51] Int. Cl.[3] ..... B08B 3/02

[52] U.S. Cl. ..... 134/199; 118/316; 239/110; 285/354

[58] Field of Search ..... 239/596, 600, 110; 285/354; 15/316, 345–346; 118/315, 316; 134/151, 172, 198–199, 82–83, 200, 45, 144, 148, 123

[56] References Cited

U.S. PATENT DOCUMENTS

| | | | |
|---|---|---|---|
| 202,700 | 4/1878 | Bullock | 239/600 |
| 954,068 | 4/1910 | Willetts | 285/354 X |
| 1,059,438 | 4/1913 | Clark | 285/354 X |
| 1,722,733 | 7/1929 | Coffey et al. | 239/110 X |
| 2,685,293 | 8/1954 | Dauphinee et al. | 134/199 X |
| 3,368,571 | 2/1968 | Honorof | 134/123 X |
| 3,674,211 | 7/1972 | Gage et al. | 134/144 X |
| 3,848,905 | 11/1974 | Hammer et al. | 285/354 X |
| 4,022,382 | 5/1977 | Engdahl, Jr. | 134/172 X |

FOREIGN PATENT DOCUMENTS

| | | | |
|---|---|---|---|
| 2437025 | 2/1976 | Fed. Rep. of Germany | 239/600 |
| 448039 | 12/1974 | U.S.S.R. | 118/316 |

*Primary Examiner*—Robert L. Bleutge
*Attorney, Agent, or Firm*—Alter and Weiss

[57] ABSTRACT

An industrial piece-part washer includes a plurality of risers depending from overhead liquid supply headers. Each riser is formed as a continuous length of pipe, along which nozzles are positioned to direct wash liquid to contact the articles to be washed. Each riser is bent, along its length, to angle said nozzles into a selected spray pattern, and each is attached at its upper end to a supply header, and at its lower end to an end cap having a weep hole formed therein. Said riser connections are formed as slipfittings so that no threads are required on the risers, and no threads are directly exposed to the liquid during washing operations.

1 Claim, 5 Drawing Figures

PIECE PART WASHER

This invention relates generally to washing apparatus, and more particularly, to commercial piece-part washers.

Industrial manufacturers often require that articles manufactured be cleaned or washed prior to shipment or further assembly operations. Such operations are common where, for example, large metal castings are involved. Working metal often requires application of special greases, oils, preservatives and the like, which must be removed after the manufacturing process has been completed. Such residue will interfere with painting, and may contaminate other machinery components when final assembly is made.

Washing such parts presents unique problems. Often, the quantity of the parts to be washed, as well as the individual sizes of the parts and the presence of numerous surface irregularities make hand washing prohibitively expensive and impractical.

In referring to such operations as washing, reference is incorporated to operations in which a liquid, gas, or suspension of solids is directed onto parts to be treated, e.g., acid in pickling operations, compressed air in drying operations, or suspensions of solids, such as paints.

It is well known in the art to construct washers for the purpose of treating such parts consisting of a series of hollow uprights through which a wash liquid is pumped, and a series of nozzles supported by said uprights to direct the wash liquid to contact the parts to be cleaned. In fact, it is not unusual for a single washing apparatus to include stations at which the articles may be treated with acid, or other reagents, stations at which the residue of such reagents may be washed away by as common a wash liquid as water, and further stations incorporating driers so that the part exits the wash apparatus in a clean, dry, and ready to use condition.

Such washers are designed to operate on a continuous basis, with parts to be washed suspended from a moving conveyor which enters the washer at a first end, and exits when washing has been completed. As the parts exit, they are removed while, simultaneously new parts are continuously added at the entrance to the washer. Maintenance of such washers is of crucial importance, for whenever cleaning or repairs must be carried out, the washer must be shut down, completely halting production.

Among the most common maintenance problems are clogging and corrosion of risers and nozzles, and leaks formed when threaded connectors cake or corrode. Many times, the wash liquid is a water-based solution, often heated, and minerals in the water, together with chemicals added for washing purposes form mineral build-ups along the inner walls of the risers, thus restricting flow and requiring higher pumping rates and pressures to wash effectively.

Conventional sprayer units, such as those typified by U.S. Pat. No. 2,305,811 utilized straight runs of piping threaded to pipe tees or pipe elbows, presenting a liquid flow path with sharp corners to be negotiated and providing abrupt changes in direction for the liquid during pumping. Such connections frequently expose a portion of the thread cut on the pipe even after the pipe has been threaded into the fitting. During washing and spraying operations, the wash liquid collects on these threads and may cause substantial corrosion.

Sharp bends not only present construction problems, they are also the cause of pressure drop in the system. It is also difficult, if not impossible, for cleaning equipment to negotiate such sharp turns and corners, and this frequently requires that the system be partially dismantled for cleaning purposes. These factors act to increase down time, concurrently increasing running, production and maintenance costs.

Accordingly, the present invention has the following objects:

To provide a piece-part washer construction featuring one-piece riser sections;

To provide such washers with riser sections having no right angles formed therein;

To provide such washers with risers which are shaped to facilitate cleaning;

To provide such washers with risers which are shaped to maximize liquid flow and spray pressure;

To provide such washers with risers enabling accurate and convenient location of spray nozzles thereon;

To provide such washers with risers which self-drain after spraying operations are completed;

To provide such washers with riser and header elements which have no exposed pipe threads when assembled;

To provide such washers with risers which may conveniently be arranged in tandem; and To provide such washers in forms economical to construct and maintain, and efficient in use.

These and further objects will become more apparent upon consideration of the accompanying drawings, in which.

Figure 1:
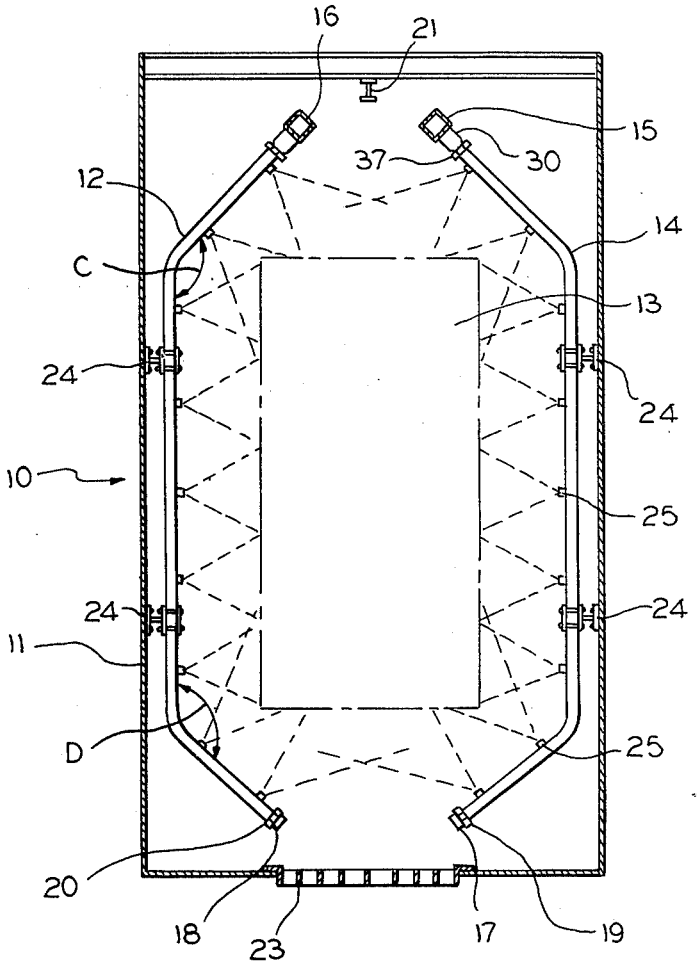
FIG. 1 is a front elevation of our inventive piece-part washer.

Consistent with the foregoing objects, we provide a piece-part washer 10 having an outer protective cabinet 11 within which are disposed a plurality of risers 12 and 14 through which liquid is pumped via supply headers 16 and 15 respectively. Risers 12 and 14 are formed from a single run of pipe having obtuse bends C and D formed thereon to angle and position nozzles 25 to create a spray pattern sufficient to treat piece-part 13. End caps 17 and 18, secured by compression nuts 19 and 20, respectively, close off the lower portion of risers 14, and 12, respectively, and have weep holes 28 formed therein to enable liquid to drain from said risers after spraying operations cease. Risers 12 and 14 are slip-fitted to supply headers 16 and 15 such that no pipe threads are exposed, and in like manner, end caps 17 and 18 are slip-fitted to the end portions of risers 14 and 12 whereby no pipe threads are exposed.

Figure 2:
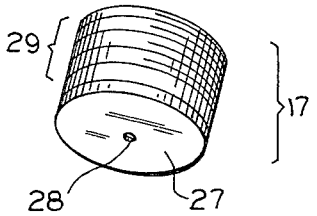
FIG. 2 is a perspective view of a riser end cap.
Figure 4:
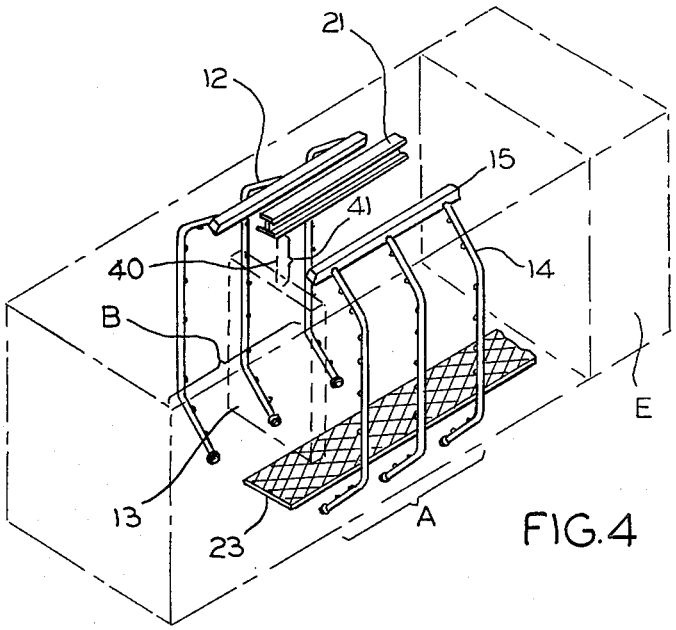
FIG. 4 is a perspective schematic view illustrating a typical washer/dryer arrangement.

Referring now to FIG. 1, the numeral 10 indicates generally a piece-part washer enclosed, throughout substantially its entire length, by cabinet 11. In a preferred embodiment, washer 10 includes a plurality of risers 12 and 14, arranged in parallel tandem rows, as illustrated in FIG. 4. As herein contemplated, and as exemplified by riser 12, each said riser is formed from a single run of pipe, and each is attached, at its uppermost end, to an overhead supply header, shown as 15 and 16 in FIG. 1. Further, each such riser is closed off at its lower end by an end cap 17, 18, as exemplified by end cap 17 illustrated in FIG. 2.

Figure 3:
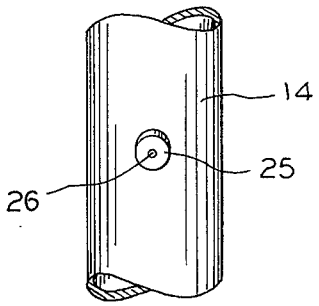
FIG. 3 is a partial perspective view of a riser section illustrating placement thereon of a spray nozzle.

Risers 12 and 14 are supported within cabinet 11, such as by riser brackets 24, shown in FIG. 1. Throughout the length of each such riser, spray nozzles 25 are positioned, each within orifice 26 formed therethrough, as seen in FIG. 3. The positioning and number of nozzles 25, and the size of orifice 26 is dictated by factors such as the wash liquid to be used, the spray area to be covered, and the variety of sizes and shapes of the articles to be washed. Nozzles 25 may be welded to riser 14, or may be threadably inserted thereon, again depending upon anticipated usage and the frequency with which nozzles 25 must be replaced.

As shown in FIG. 1, risers 12 and 14 are angled, as at bends C and D, to create a spray pattern with nozzles 25 as required to wash articles passing therebetween, as exemplified by numeral 13 in FIG. 1. The use of pipe threads is kept to a minimum, in an effort to avoid corrosion, and the fittings joining end caps 17 and 18 to risers 14 and 12, and the fittings joining risers 14 and 12 to supply headers 15 and 16 having been selected such that any pipe threads required to effect connection are completely covered during wash operations.

Figure 5:
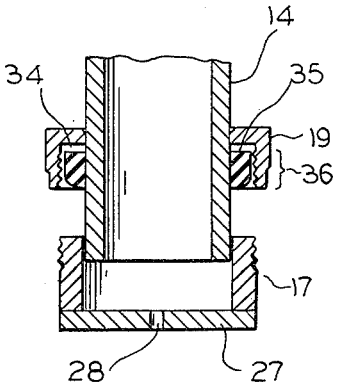
FIG. 5 is a side sectional view illustrating a preferred attachment of the end cap.

As an example, a preferred embodiment illustrating attachment of end cap 17 to riser 14 is shown in FIG. 5. End cap 17 has weep hole 28 formed therethrough, and is externally threaded as seen at 29 of FIG. 2, for a portion of its length.

End cap 17 may be secured to riser 14 by means of compression nut 19. As best seen in FIG. 5, land 34 is formed within compression nut 19, sized and shaped to position sealing element 35 therewithin. In a preferred embodiment, sealing element 35 is formed from rubber, and is shaped to be distorted to contact the outer walls of riser 14 when compression nut 19 is slipped over end cap 17 and tightened. Compression nut 19 is internally threaded, as seen at 36, to correspond with external threads 29.

To secure end cap 17 to riser 14, compression nut 19 is slipped onto riser 14, as shown in FIG. 5. End cap 17 is then slipped onto riser 14 to close off said riser. Compression nut 19 is then moved along riser 14 to engage threads 29 with threads 36, whereupon compression nut 19 may be threaded to end cap 17, expanding sealing element 35 to complete a liquid-tight seal. Only so many threads as are necessary to secure a tight fit must be cut on end cap 17, such that when compression nut 19 is threaded fully thereon, no threads will be exposed. In a preferred embodiment, only four threads are cut onto end cap 17, and compression nut 19 overlaps all said threads when assembled.

A similar type of fitting may be employed to attach riser 14 to header fitting 30, using compression nut 37. Riser 14 is slipped into fitting 30, and nut 37 is tightened onto threads formed externally on fitting 30, in a manner similar to that described above. The inside diameter of header fitting 30 and end cap 17 is selected to provide a close fit with the outside diameter of riser 14.

As seen in FIG. 4, tandem arrangement of risers 12 and 14, and positioning thereon of nozzles 25 creates a spray zone therebetween, and it is through this zone that an article 13 to be washed may be moved.

In a preferred embodiment, cabinet 11 has I-beam 21 attached thereto to support an overhead trolley, schematically illustrated at 40 in FIG. 4. Article 13 may be suspended, as by elongated s-hooks or the like, as at 41, and may be drawn through said zone by trolley 40. Most commonly, trolley 40 comprises a form of overhead conveyor chain, from which said hooks are suspended.

As best seen in FIG. 4, cabinet 11 extends to enclose the entire washing apparatus, including the bank of risers 14 in tandem, at A, and risers 12 in tandem, at B, and the overhead trolley support 21. In this manner, splashing and dripping occuring during washing is contained, and a floor drain 23 may be provided to collect used wash liquid for eventual disposal, purification or reuse. Housing 11 may also be extended to include other wash components, as indicated at E of FIG. 4. Such components could typically include a second bank of risers utilizing a different wash liquid, a drying unit or a paint spraying station. In this manner, piece-parts may be processed in a controlled environment, and in a manner which limits the mess and hazard inherent in such spray operations.

Our present invention also offers many advantages in extending the in-service time between required maintenance operations. When material build-up within risers 12 and 14 acts to restrict flow, cleaning operations are facilitated by the fact that no sharp bends are formed in said risers, and from the fact the the risers are formed from a single run of pipe. Cleaning of riser 14 may be accomplished, for example, by removing end plug 17 and by uncoupling riser 14 from header fitting 30. A cleaning element, such as a wire brush may then be inserted along the entire length of riser 14, and the deposits so loosened may be flushed from riser 14.

Bends C and D of risers 12 and 14 may be selected to create a spray pattern which provides optimum coverage for the articles to be washed.

While the foregoing has presented specific embodiments of our invention, such embodiments have been presented by way of example only. It is expected that others skilled in the art will perceive variations which, while differing from the foregoing, do not depart from the spirit and scope of the invention as herein described and claimed.

I claim:

1. In an industrial piece-part washer of the type having a plurality of upstanding hollow riser pipes, each said riser pipe having two ends, each said riser pipe communicating with a supply header, and riser pipes and said supply headers defining a flow path for a selected wash fluid, said riser pipes having nozzles disposed therealong to direct said wash fluid from the interior of said riser pipe to contact an article to be washed, the improvement comprising:

a pair of said supply headers arranged in overhead horizontal parallel spaced relationship;

forming each said riser pipe as a single, uninterrupted run of piping;

joining a plurality of said riser pipes to depend from each said supply header, forming parallel ranks of riser pipes, each said riser pipe having two bends formed therealong, a first riser segment extending from the first of said ends to the first of said bends, a second riser segment extending from the first of said bends to the second of said bends, a third riser segment extending from the second of said bends to the second of said ends, each said riser pipe joined to one said supply header at the first of said ends, forming a straight run of pipe from said supply header to the first of said bends, said bends formed to disposed said second riser segment in a vertical orientation when said riser pipes are joined to said supply headers, said riser pipes in one said rank extending toward said riser pipes in the remaining said rank, said first riser segment and said third riser segment of each said riser pipe angled toward said second riser segment with the angle between said first and second second riser segments and said second and third riser segments, respectively, being greater than 90°; and an end cap non threadably attachable to the second end of each said riser pipe to at least partially impede the flow of wash fluid through said riser pipe and allow said wash fluid to be directed to said nozzles.

* * * * *